United States Patent [19]

Alexander

[11] 4,226,098

[45] Oct. 7, 1980

[54] LEATHER YARN PRODUCING MACHINE

[76] Inventor: William M. Alexander, 1835 Elmwood Dr., Hillsborough, Calif. 94010

[21] Appl. No.: 973,443

[22] Filed: Dec. 26, 1978

[51] Int. Cl.[3] ..... C14B 00/00

[52] U.S. Cl. ..... 69/2

[58] Field of Search ..... 69/9, 11, 12, 21, 15, 69/2; 66/202; 428/225, 364, 401

[56] References Cited

U.S. PATENT DOCUMENTS 4,131,713 12/1978 Barta et al. ..... 69/21

*Primary Examiner*—Patrick D. Lawson

*Attorney, Agent, or Firm*—Owen, Wickersham & Erickson

[57] ABSTRACT

A machine for producing a strand of fine leather yarn from a leather disc is disclosed. The machine includes a rotatable turntable with an array of suction holes in its upper surface for receiving the leather disc, stiffening it for cutting and tightly gripping it for rotation with the turntable. A cutting wheel is positioned just above the turntable and is rotatably driven on an axis lying generally radially with respect to the turntable. A frame above the turntable supports the cutting wheel and provides for advancement of the cutting wheel radially inwardly as the cutting of leather yarn from the peripheral edge of the leather disc progresses. The speed of inward advancement of the cutting wheel is maintained at a fixed ratio to the speed of rotation of the turntable, so that a constant width of leather yarn is obtained. The advancement may be by means of a rotatable screw shaft linked mechanically to and rotatably driven by the driving means for the turntable. The speeds of rotation of the turntable and of advancement of the cutter may be increased as the cutting operation moves toward the center of the turntable so that the linear speed of production of the leather yarn is held more or less constant. There is preferably included some sort of takeup device for removing the leather yarn from the turntable as it is cut from the disc.

11 Claims, 5 Drawing Figures

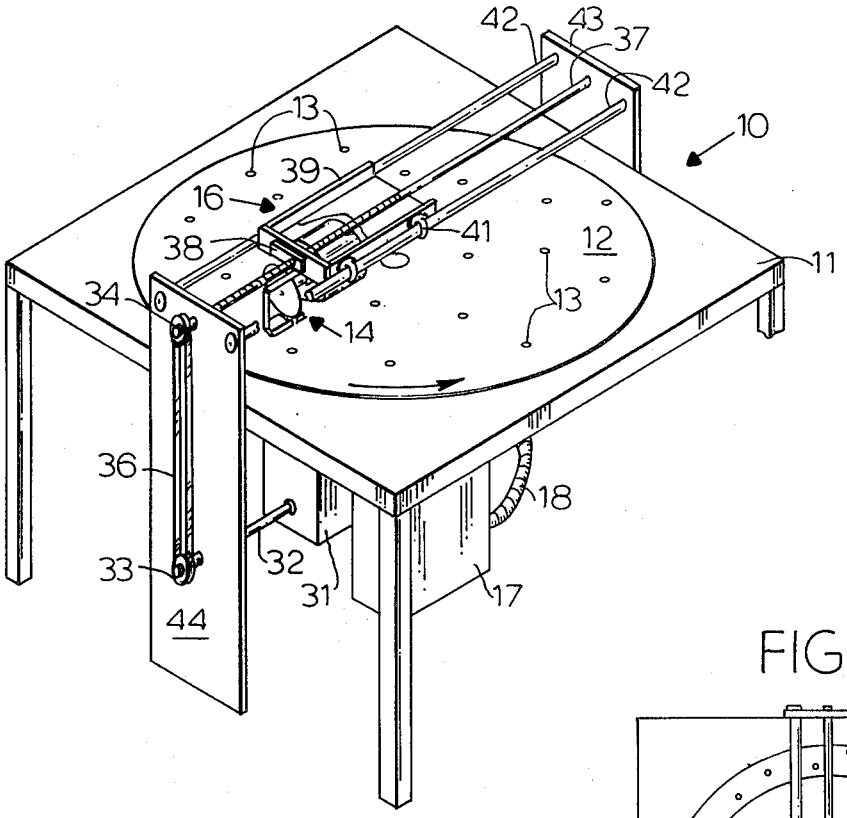
FIG. 1
FIG. 2
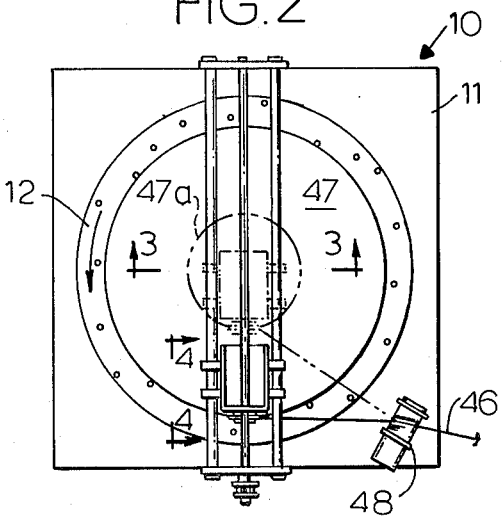
FIG. 4
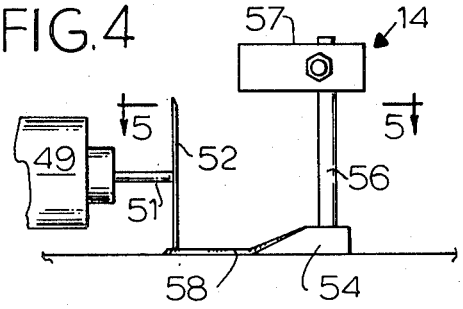
FIG. 5
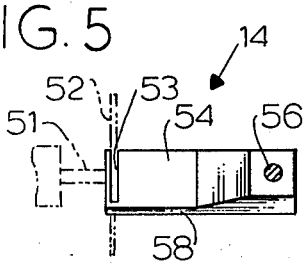
FIG. 3
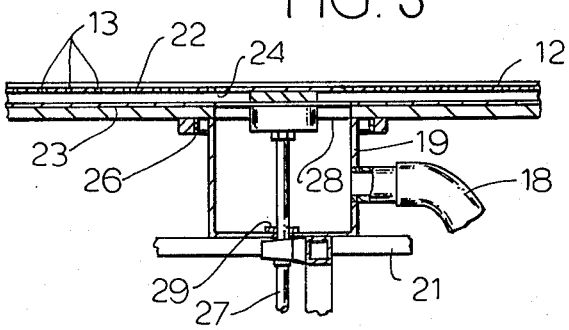

LEATHER YARN PRODUCING MACHINE

BACKGROUND OF THE INVENTION

The invention relates to leather working machinery, and more particularly to a machine for cutting a soft leather disc into a leather yarn strand capable of being knit into fabrics similarly to other yarn type products.

There have previously been attempts made to produce a fine leather yarn which is attractive, useful and practicable. See, for example, Arbib U.S. Pat. No. 2,067,895. However, to be practicable for use in garments and other fine knit items, a leather yarn must not only be soft and fine but also must be of precise, consistant dimensions so as to enable the yarn to be knit with knitting machinery. There is disclosed in copending application Ser. No. 807,361, now U.S. Pat. No. 4,131,713, to Leslie P. Barta and William M. Alexander, a leather yarn which meets these requirements, and a method for producing such a leather yarn. There is also disclosed a type of machine for cutting the leather yarn from a leather disc. The machine utilized a smooth-surfaced platform for the leather disc, and a rotatable spindle with prongs for gripping the leather disc centrally from below, so that the leather disc was driven rotatably on the smooth surface with very little friction. A fixed-position cutter was located at the periphery of the leather disc for cutting a fine leather yarn from the peripheral edge of the disc as the disc rotated. A sizing was used on the leather disc prior to cutting, to temporarily stiffen it for the cutting operation, thereby avoiding bunching of the leather disc at the point of cutting and providing a uniform cut strand. Mechanism was provided for advancing the spindle, and thus the entire leather disc, in a radial direction toward the cutting blade as cutting progressed, so that a uniform leather strand continued to be cut until the center of the leather disc reached the blade. The speed of rotation and of advancement of the leather disc were increased as the cutting progressed so that the linear speed of production of the cut leather yarn did not drop off as sharply as the leather disc became smaller and smaller.

While the machine disclosed in the above patent was effective to produce a leather yarn of the desired parameters, the stiffening of the leather by sizing did not completely eliminate the risk of bunching at the cutting blade, in part because the leather disc was required to rotate freely on the smooth surface below. The driving force for rotation of the leather disc was applied only at the center of the disc, remote from the cutting operation, so that when the cutting blade encountered significant resistance, as can be expected to occur due to the fibrous nature of the leather, bunching and/or irregular cutting could often be expected to occur. Stresses generated at the cut were transmitted through the radius of the disc to the driven center, causing stress and stretching undulation. Also, the mechanics of moving the driving spindle toward the cutting blade, as compared to the present invention, were somewhat inefficient.

SUMMARY OF THE INVENTION

The present invention provides an improved leather yarn cutting machine which enables a much faster production rate while maintaining precise control of the quality of the leather yarn product. The machine includes a rotating turntable over which the leather disc lies, the disc being driven with the turntable rather than sliding freely on a surface as in the above mentioned U.S. Pat. No. 4,131,713. The stiffening of the leather disc for cutting, as well as the attainment of the required friction between the disc and the turntable for driving the disc with the turntable, are achieved preferably via suction holes in the turntable surface, to which vacuum is constantly applied during cutting. This could also be achieved via a forced air blast from above, or by either of these means in combination with sizing of the disc, but sizing is not required. The use of the suction retention of the disc on the turntable, i.e. the use of a differential pressure between the upper side and the lower side of the leather disc, provides for driving engagement of the leather disc at a multitude of points on the turntable, so that precise control of the cutting operation is achieved. Such control is important in obtaining the required thinness of size, continuity and uniformity of dimensions of the soft leather yarn thus produced. The suction turntable holds the leather securely in place and prevents bunching at the cutting blade, which was heretofore a limiting factor in obtaining a precisely cut, narrow-width strand of soft leather. It also permits a greatly increased rate of production.

Instead of advancing the rotating leather disc towards the cutting blade as the cutting operation progresses, the present invention utilizes a frame-supported movable cutting assembly, positioned just above the turntable. As cutting progresses, the cutting assembly is moved inwardly synchronously with rotation of the turntable so that the proper spiral cut is achieved and uniformity of width of the cut leather yarn is maintained. The synchronization of the cutting assembly's advancement with the rotation of the turntable is accomplished by mechanical linkage between the driving assembly of the turntable and the advancing mechanism of the cutter. Adjustment of the width of the cut leather yarn can therefore be made simply by adjusting this mechanical linkage to change the ratio of the two speeds of movement.

This combination including a traversing cutting head and a rotating vacuum turntable provides for the required stiffening of the soft leather disc to produce a fine yarn with close tolerance as to size and consistancy, and at a rapid rate of production. In addition, the vacuum turntable is efficient in that it eliminates time which would be required for the application of a sizing compound to stiffen the leather disc. Because the leather disc is stationary relative to the rotating turntable, the tendency of the soft leather to bunch at the cutting head is practically eliminated.

Thus, the entire process of producing the leather yarn described in the aforesaid U.S. Pat. No. 4,131,713 is increased in speed and the tolerances required are more easily achieved. The rotating vacuum turntable drives the leather disc past a traversing cutting head to separate a desired width of yarn from the disc. The suction drawn through appropriately spaced holes in the turntable surface provides the temporary stiffening needed to hold the soft piece of leather in place during cutting and to provide the rigidity needed to attain the width tolerances desired for use of the yarn in knitting machinery. The need for such tolerances is discussed in U.S. Pat. No. 4,131,713.

Important features of this invention are: (1) the handling of soft and very flexible leather by use of vacuum in such a manner as to be able to cut a strand from the outside perimeter of the material to the fine dimensions discussed in U.S. Pat. No. 4,131,713; (2) the rotating turntable for the leather disc, rather than a low-friction surface for sliding of the disc. This provides for the even application of driving force to the leather disc, and a stable and even surface supporting the disc, so that precise control of cutting is aided; and (3) a traversing cutting head which moves generally radially with respect to the turntable, with a mechanical synchronizing linkage between the turntable drive and the cutting head movement, so that the width of the leather yarn produced is consistent but can be varied by adjusting the synchronization mechanism.

The leather piece used in the cutting operation is preferably a circular disc, but need not be precisely circular. If the shape is noncircular, even square or rectangular, it may nonetheless be placed upon the turntable and it will be rendered into a circular disc by the motion of the turntable and the cutting head. Some scrap will be generated, but once the leather is cut to a circular disc, a continuous strand of leather yarn will be generated.

Although the cutting of the leather yarn preferably proceeds from the outside of the leather disc, inwardly, it could alternatively proceed from the center outwardly, with appropriate takeup means removing the cut leather yarn from the turntable.

As the spiral cutting of the leather disc into leather yarn progresses inwardly, and the disc becomes smaller in diameter, more and more of the suction holes in the turntable are uncovered and exposed to the atmosphere. This causes the suction applied to the remaining suction holes, toward the center of the turntable, to be progressively weakened, if all of the suction holes are connected to a single vacuum source as is preferred. This effect can be reduced by spacing the suction holes widely apart near the periphery of the turntable, then progressively closer together toward the center. In this way, fewer holes are exposed to the atmosphere initially, and adequate suction can be provided to the reduced-diameter disc without difficulty. Of course, the vacuum source must be sufficiently strong to adequately grip and stiffen the leather disc even as it approachs its smallest diameter which is possible to cut. A very large vacuum source is one simple solution to the problem.

Alternatively, other means may be provided for minimizing the effect of the progressive uncovering of these suction holes. For example, some means may be provided for progressively cutting off the suction holes from the vacuum source as they are uncovered by the reduction in diameter of the leather disc. This may comprise, for example, a type of valving device employing a mechanism similar to the iris, or f-stop control of a cameral lens. It could also comprise a type of inertia valving means associated with each suction hole, at least with the suction holes positioned toward the outside of the turntable, whereby the suction hole is normally connected to vacuum, but a sudden rush of air into the suction hole will cause a valve member to close against a valve seat and remain closed under the effect of the suction. Such apparatus enables the use of a smaller and more economical vacuum source.

Accordingly, in one embodiment a machine for producing leather yarn from a disc of leather according to the invention comprises a base; a turntable supported by the base for rotation thereon, for receiving the leather disc on its exposed surface; motor means for driving the turntable rotatably; means associated with the turntable for creating a pressure differential between the upper side and the lower side of the leather disc when it is on the turntable, with the lower side being at lower pressure, so that the leather disc is caused to lie tightly against the turntable to thus be stiffened and to be driven with the turntable; cutting means for cutting a yarn in a spiral pattern from the leather disc as the turntable rotates, and frame means connected to the base for supporting the cutting means above the turntable; and means for advancing the cutting means radially as the turntable rotates, so that the leather yarn is cut spirally from the disc.

It is therefore among the objects of the invention to provide an improved machine for cutting leather yarn from a disc of soft, high-quality leather, with speed of production and dimensional control substantially increased. This and other objects, advantages and features of the invention will be apparent from the following description of a preferred embodiment, taken in conjunction with the appended drawings.

DESCRIPTION OF THE DRAWINGS

FIG. 1 is a perspective view showing a leather yarn cutting machine according to the invention.

FIG. 2 is a plan view of the machine, shown cutting a disc of leather into leather yarn.

FIG. 3 is a sectional detail view showing a portion of a suction turntable apparatus which forms a part of the invention, taken along the line 3—3 of FIG. 2.

FIG. 4 is an enlarged front elevational view showing the cutting assembly of the machine.

FIG. 5 is a plan view of the cutting assembly, taken along the line 5—5 of FIG. 4.

DESCRIPTION OF A PREFERRED EMBODIMENT

In the drawings, FIG. 1 shows a leather yarn cutting machine 10 according to the invention, including a table or platform 11, a rotatable turntable 12 for receiving a leather disc on its surface, with a large number of suction holes 13 in the surface of the turntable for retaining the leather on the surface while the turntable rotates and for stiffening the leather for the cutting operation, a cutting assembly 14 and a cutter mounting and traversing assembly 16. A vacuum source 17 is provided, with a suction line 18 leading from the source ultimately to the suction holes 13 at the turntable surface. FIG. 3 illustrates the manner in which the vacuum suction is communicated to the suction holes. The suction line 18 connects to a plenum chamber 19 which is stationary and non-rotational, being connected to structural members 21 associated with the table 11. The table and the various structural members associated with it comprise a base for the leather cutting machine. Just above the stationary plenum chamber 19 is the turntable 12, which has an upper surface plate 22 and a lower plate 23, defining between them another plenum chamber 24 in open communication with the plenum chamber 19. A seal 26, which is affixed to the lower side of the lower turntable plate 23, encircles and sealingly engages against the outside of the plenum chamber 19, so that the turntable may rotate with respect to the chamber 19 without appreciable loss of vacuum.

FIG. 3 also indicates a driving shaft 27 for the turntable, affixed to portions 28 of the lower base plate of the turntable. The shaft 27 passes through the bottom of the plenum chamber 19, where another seal 29 prevents air leakage. The shaft 27 extends to a motor and gearing assembly which is indicated at 31 in FIG. 1.

As also illustrated in FIG. 1, the motor and gearing assembly also preferably is connected via a shaft 32, to the cutter advancing assembly 16. The shaft 32 has at its end a sprocket or notched pulley member 33, such as a timing pulley, connected to an upper, similar sprocket or pulley 34 by a chain or timing belt 36, such that there is no slipage of the connector 36 and the same ratio is always maintained between the speeds of rotation of the sprockets or pulleys 33 and 34. The upper sprocket or pulley 34 is connected to rotatable screw shaft 37 which advances the cutting assembly 14 via a threaded member 38 connected to a movable carriage 39 on which the cutting assembly 14 is mounted. The carriage 39 has slide bearings 41 which move along a pair of support bars 42 connected to end frame members 43 and 44 of the base assembly.

The shaft 32 which transmits rotational motion to the advancing screw shaft 37 is connected mechanically, via the motor and gearing unit 31 to the driving shaft 27 of the turntable (FIG. 3). Thus, the rotations of the turntable 12 and of the screw shaft 37 are always synchronized, i.e. the speed of rotation of the advancing screw shaft 37 is always at a fixed ratio with respect to the speed of rotation of the turntable. In this way, the strand of leather yarn 46 which is cut from the leather disc 47 is always of a consistent width (see FIG. 2), since the amount of advancement of the cutting assembly 14 is the same for each successive revolution of the turntable 12. Of course, the width of the yarn strand 46 may be adjusted by changing the ratio between the speeds of the turntable and of the screw 37. This may be accomplished, for example, simply by changing the size of one of the sprockets or pulleys 33 or 34.

FIG. 2 shows the apparatus of the invention cutting a strand of leather yarn 46 from a disc 47. As explained previously, the disc 47 is preferably circular originally, but it may be somewhat out of round since the first revolution of cutting will eliminate the irregularities. As illustrated, the machine preferably includes some sort of takeup means for the cut yarn 46, for removing it from the turntable. This may comprise a motorized low-friction spinning spool or pulley supported on the table 11, as indicated in FIG. 2. The takeup device 48 preferably spins at a higher surface speed than the speed of production of the leather yarn 46, to create a continuing drag on the yarn, to lift it away from the turntable and vacuum, and to deliver it to a collection area.

FIG. 2 illustrates the progressive cutting of the leather disc 47 from an initial larger diameter to a smaller and smaller diameter, with the disc indicated at 47*a*, having been cut to a much smaller diameter. The cutter assembly 14 and its carriage 39 have of course moved close to the center of the turntable 12. As this occurs, the linear speed of production of the leather yarn will decrease, assuming the turntable continues to be driven at the same rate. However, a variable rate of rotation may be provided, such that the speed of the turntable and of the cutter advancing carriage increases as cutting progresses, so that a generally constant rate of yarn production can be maintained, or at least. so that the speed does not fall objectionably low. This feature may be provided via the motor and gearing assembly 31, simply by providing a variable speed motor or variable speed gearing. Such apparatus is well known and commonly available, and may include, for example, a Zero-Max infinitely variable drive gear box and motor assembly, manufactured by the Zero-Max Company.

As also illustrated in FIG. 2, the suction holes 13 of the turntable are uncovered as the leather disc 47 is cut to a progressively small diameter. More holes are uncovered as cutting continues. This reduces the suction applied at the remaining working suction holes. The suction, however, must remain adequate to hold the leather disc against the turntable and provide adequate stiffening for the precise cutting that is desired. So that the vacuum source 17 need not be overly large, the suction holes 13 may be spaced more widely apart toward the periphery of the turntable, and closer together toward the center. Alternatively, some form of progressive cut off of suction holes could be provided, as discussed above (not illustrated).

FIGS. 4 and 5 illustrate in greater detail the cutting assembly 14. FIG. 4 is a view of the front of the assembly, i.e. the side into which the leather disc rotates. The assembly includes a motor 49 having a shaft 51 supporting a circular cutting blade 52. The blade 52 extends into a groove or slot 53 in a "foot" device 54 which is suspended by structural members 56 and 57 from the cutter-traversing carriage 39 above. The foot 54 extends into close proximity with, but preferably does not touch, the surface of the turntable 12 below. Its front edge 58 is tapered for smoothly lifting the edge of the leather disc up to the blade 52 for cutting. The boundaries of the slot 53 act as shearing edges to assist the blade 52 in making a clean cut. Thus, the leather disc is lifted only slightly from the turntable, at the disc's outer edge, and the stiffening of the disc by the suction applied at the turntable is not reduced in effectiveness.

It should be understood that many of the features described herein may suitably be carried out in alternate ways. For example, for coordination of the speeds of movement of the turntable and the cutter advancing device, other suitable mechanical or electronic means, known to persons skilled in the art, may be used. The terms "up", "down", "above", "below", etc., as used herein and in the claims, are intended to refer to the machine of the invention only as a convenient reference, for the machine orientation shown in the drawing. The machine need not be oriented as shown in the drawing, but may have the turntable axis horizontal or oblique, or the unit may even be inverted if desirable in some circumstances. Also, as discussed above, the retention and stiffening of the leather disc on the turntable may be by forced air directed downwardly against the exposed side of the disc, creating a pressure differential between the upper side and the lower side of the disc, in lieu of the use of suction as described above. The cutting means need not be a blade, but rather can include a laser beam. Also, one could utilize a cammed overhead mechanism that photo-electrically or through shape pre-programming follows an irregular shape such as a hyde may take, progressing inwardly each circuit by a distance equal to the desired width of the yarn. These and various other modifications to the preferred embodiment described above will be apparent to those skilled in the art and may be made without departing from the spirit and scope of the following claims.

I claim:

1. A machine for producing leather yarn from a disc of leather, comprising:

a base;

a turntable supported by the base for rotation thereon, for receiving the leather disc on its exposed surface;

motor means for driving the turntable rotatably;

means associated with the turntable for creating a pressure differential between the upper side and the lower side of the leather disc when it is on the turntable, with the lower side being at lower pressure, so that the leather disc is caused to lie tightly against the turntable to thus be stiffened and to be driven with the turntable;

cutting means for cutting a yarn in a spiral pattern from the leather disc as the turntable rotates, and frame means connected to the base for supporting the cutting means above the turntable; and means for advancing the cutting means radially as the turntable rotates, so that the leather yarn is cut spirally from the disc.

2. The machine of claim 1 wherein the cutting means includes a cutting blade oriented generally vertically and foot means for extending under and lifting the leather slightly above the turntable in the area of cutting, with a shearing edge closely adjacent to the cutting blade.

3. The machine of claim 2 wherein the foot means comprises a horizontal platform above and closely adjacent to the turntable, positioned to pick up the edge of the rotating leather disc, said cutting blade comprising a rotatable cutting wheel having a peripheral cutting edge, with means for driving the wheel rotatably.

4. The machine of claim 2 wherein the foot means comprises a horizontal platform above and closely adjacent to the turntable, with a slot in the platform oriented in a tangential direction to the turntable, said platform being positioned to pick up the edge of the rotating leather disc, said cutting blade comprising a rotatable cutting wheel having a peripheral cutting edge which extends into the slot of the platform, thereby to cleanly sever the yarn from the leather disc.

5. The machine of claim 1 which further includes means for increasing the speed of rotation of the turntable and the speed of advancement of the cutting means as cutting progresses radially inwardly, so that the linear speed of leather yarn leaving the turntable is held generally constant.

6. The machine of claim 1 wherein the means for advancing the cutting means comprises a rotatable screw shaft supported by the frame means in generally radial orientation above the turntable, means for driving the screw shaft rotatably and follower means connected to the cutting means and in engagement with the screw shaft for moving the cutting means as the shaft rotates.

7. The machine of claim 6 wherein the driving means for the screw shaft includes means coupling the screw shaft to the motor driving means of the turntable so that a constant ratio is maintained between the speeds of rotation of the turntable and of the screw shaft.

8. The machine of claim 1, further including takeup means for removing and receiving the cut leather yarn from the turntable.

9. The machine of claim 1 wherein the means for creating a pressure differential comprises an array of bores in the turntable, open to the turntable surface, and vacuum means for applying a suction to the boxes.

10. The machine of claim 9 wherein the vacuum means comprises a common vacuum source connected to all the bores, and wherein the bores are progressively more closely spaced toward the center of the turntable, so that as leather yarn is cut from the outer edge of the disc and the disc becomes smaller in diameter, exposing suction bores to the atmosphere, adequate suction remains to retain and continue to stiffen the disc on the turntable.

11. A leather yarn cutting machine for producing a thin strand of leather yarn from a disc of leather, comprising:

a base;

a turntable supported on the base for rotation thereon, for receiving the leather disc on its upper surface;

an array of bores in the turntable surface, and vacuum means for applying a suction through the bores to draw the leather disc to the turntable surface so that the leather disc is stiffened and caused to rotate with the turntable;

a rotatable cutting blade for cutting a yarn from the outer edge of the leather disc as the turntable rotates, said blade being positioned just above the turntable on an axis oriented generally radially with respect to the turntable, means for driving the cutting blade rotatably, carriage means for supporting the cutting blade and its driving means, and frame means connected to the base for supporting the carriage means for slidable movement in a generally radial direction with respect to the turntable;

means for advancing the cutting blade radially inwardly with respect to the turntable as the turntable rotates;

motor means for synchronously driving the turntable and the advancing means at a constant ratio of speed relative to one another; and means for removing the cut leather yarn from the turntable.

* * * * *